US005642740A

United States Patent [19]

Chen

[11] Patent Number: 5,642,740

[45] Date of Patent: Jul. 1, 1997

[54] HAIR HOLDER

[76] Inventor: Chin-Chin Chen, No. 48, Dwan Ming St., Kaohsiung, Taiwan

[21] Appl. No.: 547,598

[22] Filed: Oct. 24, 1995

[51] Int. Cl.[6] ..... A45D 8/20

[52] U.S. Cl. ..... 132/277; 132/279; 132/282; 132/132; 132/156

[58] Field of Search ..... 132/277, 275, 132/276, 278, 279, 282, 132, 133, 134, 138, 151, 156

[56] References Cited

U.S. PATENT DOCUMENTS

| | | | |
|---|---|---|---|
| 1,194,844 | 8/1916 | Kalinowska | 132/277 |
| 2,166,460 | 7/1939 | Burns | 132/277 |
| 2,540,042 | 1/1951 | Graigen | 132/276 |
| 2,549,193 | 4/1951 | Grison | 132/276 |
| 5,549,127 | 8/1996 | Chang | 132/276 |

*Primary Examiner*—Gene Mancene
*Assistant Examiner*—Pedro Philogene
*Attorney, Agent, or Firm*—Larson and Taylor

[57] ABSTRACT

A hair holder includes a pair of members having a middle portion pivotally coupled together and having a number of teeth formed in the lower portion and each having a handle formed in the upper portion. A spring may bias the handles away from each other so as to bias the teeth toward each other. A pair of panels are pivotally coupled together and each has one edge pivotally coupled to the handles so as to allow the panels to rotate relative to the handles. The panels may shield the pivot shaft and the spring so as to prevent the hair from being clamped by the spring.

6 Claims, 8 Drawing Sheets

HAIR HOLDER

BACKGROUND OF THE INVENTION

1. Field of the Invention

The present invention relates to a hair holder, and more particularly to a hair holder having a device for shielding the spring members.

2. Description of the Prior Art

A typical hair holder is disclosed in FIG. 9 and comprises a pair of bodies 90 including a middle portion having two pairs of lugs 91 extended therefrom and pivotally coupled together by a pivot shaft 92. The bodies 90 include a number of teeth or bristle elements 94 formed on one end thereof for engaging with the hair and include a pair of handles 95 formed in the other end. A spring 93 is engaged on the pivot shaft 92 and engaged with the handles 95 for biasing the handles 95 away from each other and for biasing the teeth 94 toward each other so as to engage with the hair. However, the spring 93 is exposed such that the hair may be easily clamped between the spring 93 and the handles 95.

The present invention has arisen to mitigate and/or obviate the afore-described disadvantages of the conventional hair holders.

SUMMARY OF THE INVENTION

The primary objective of the present invention is to provide a hair bolder which includes a device for shielding the spring member.

In accordance with one aspect of the invention, there is provided a hair holder comprising a pair of bodies including a middle portion pivotally coupled together at a pivot shaft, the bodies each including a lower portion having a plurality of teeth extended therefrom and each including an upper portion having a handle means formed therein, means for biasing the handles away from each other and for biasing the teeth toward each other, and a pair of panels each including a first edge pivotally coupled to the handles and each including a second edge pivotally coupled together so as to allow the panels to rotate relative to each other and to rotate relative to the handles and so as to allow the panels to shield the pivot shaft and the biasing means.

The first edges of the panels are pivotally coupled to the handles at a flexible hinge so as to allow the panels to rotate relative to the handles.

The first edges of the panels each includes an extension extended therefrom and each includes a pivot axle engaged through the extension and engaged through the handles so as to pivotally couple the panels to the handles and so as to allow the panels to rotate relative to the handles.

The second edges of the panels are pivotally coupled together at a flexible hinge so as to allow the panels to rotate relative to each other.

The second edges of the panels each includes a pair of ears extended therefrom, and the hair holder includes a pivot pin engaged through the ears so as to pivotally couple the panels together and so as to allow the panels to rotate relative to each other.

The panels include a width greater than that of the pivot shaft so as to shield the pivot shaft and the spring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
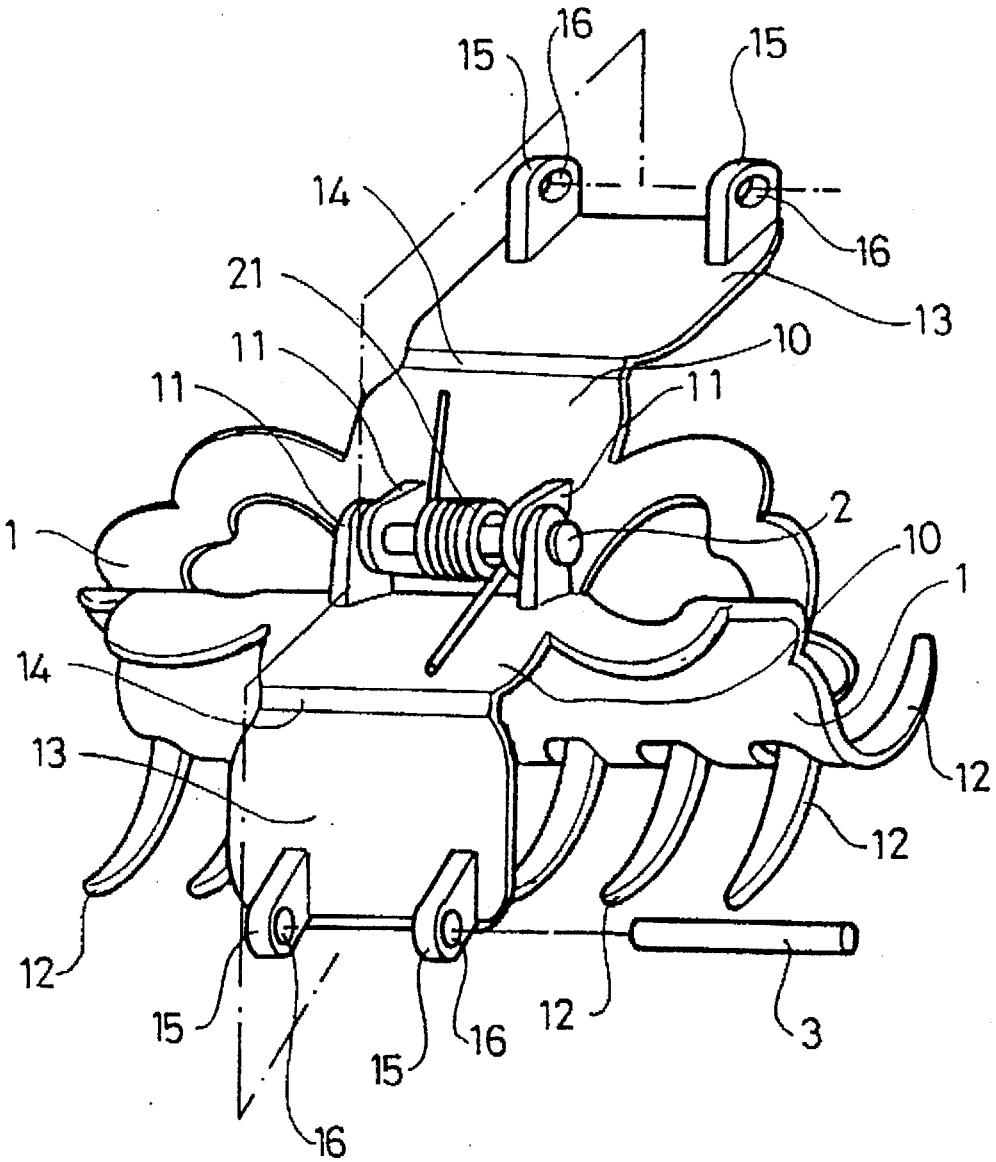
FIG. 1 is a perspective view of a hair holder in accordance with the present invention, in which a pivot shaft has been disengaged from the hair holder.
Figure 2:
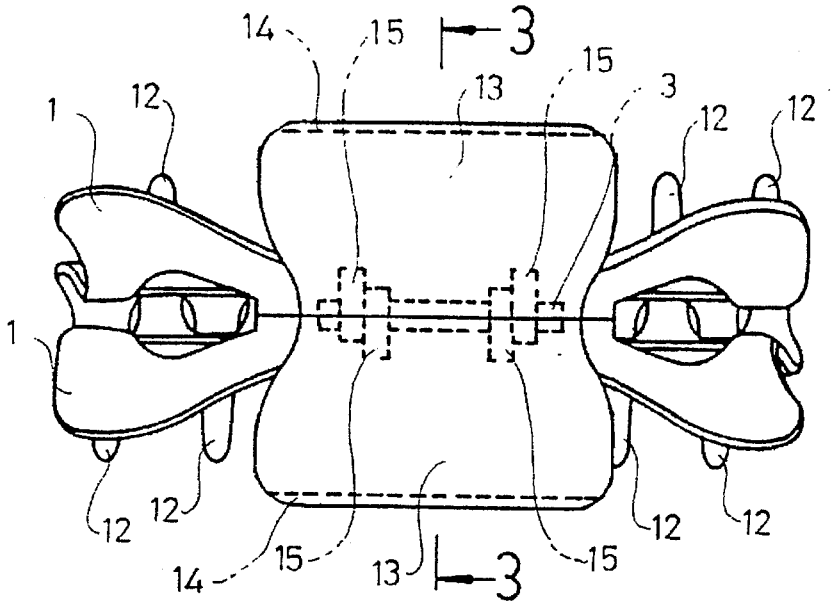
FIG. 2 is a top view of the hair holder.
Figure 3:
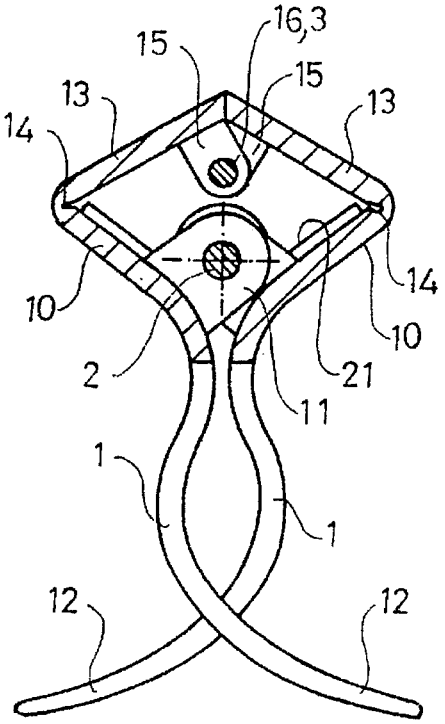
FIGS. 3 and 4 are cross sectional views taken along lines 3—3 of FIG. 2, illustrating the operation of the hair holder.

Referring to the drawings, and initially to FIGS. 1 to 3, a hair holder in accordance with the present invention comprises a pair of bodies 1 each including a middle portion having a pair of lugs 11 extended therefrom and pivotally coupled together by a pivot shaft 2. The bodies 1 each includes a number of teeth or bristle elements 12 formed on the lower portion thereof for engaging with the hair and each includes a pair of handles 10 formed in the other end. A spring 21 is engaged on the pivot shaft 2 and engaged with the handles 10 for biasing the handles 10 away from each other and for biasing the teeth 12 toward each other so as to engage with the hair. The teeth 12 of the bodies 1 may be separated from each other when the handles 10 are forced toward each other by the users.

The bodies 1 each further includes a panel 13 extended from the handles 10 respectively and pivotally coupled to the handles 10 at a flexible hinge 14. The panels 13 may include suitable shape and may include suitable patterns printed thereon. It is preferable that the panels 13 include a width larger than the length of the pivot shaft 2. The panels 13 each includes a pair of ears 15 extended therefrom. The ears 15 each includes a hole 16 formed therein for engaging with a pivot pin 3 such that the panels 13 are pivotally coupled together at the pivot pin 3. As best shown in FIGS. 2 and 3, the lugs 11, the pivot shaft 2 and the spring 21 are suitably shielded by the panels 13 so as to prevent the hair from being clamped by the spring 21 and the lugs 11.

Figure 4:
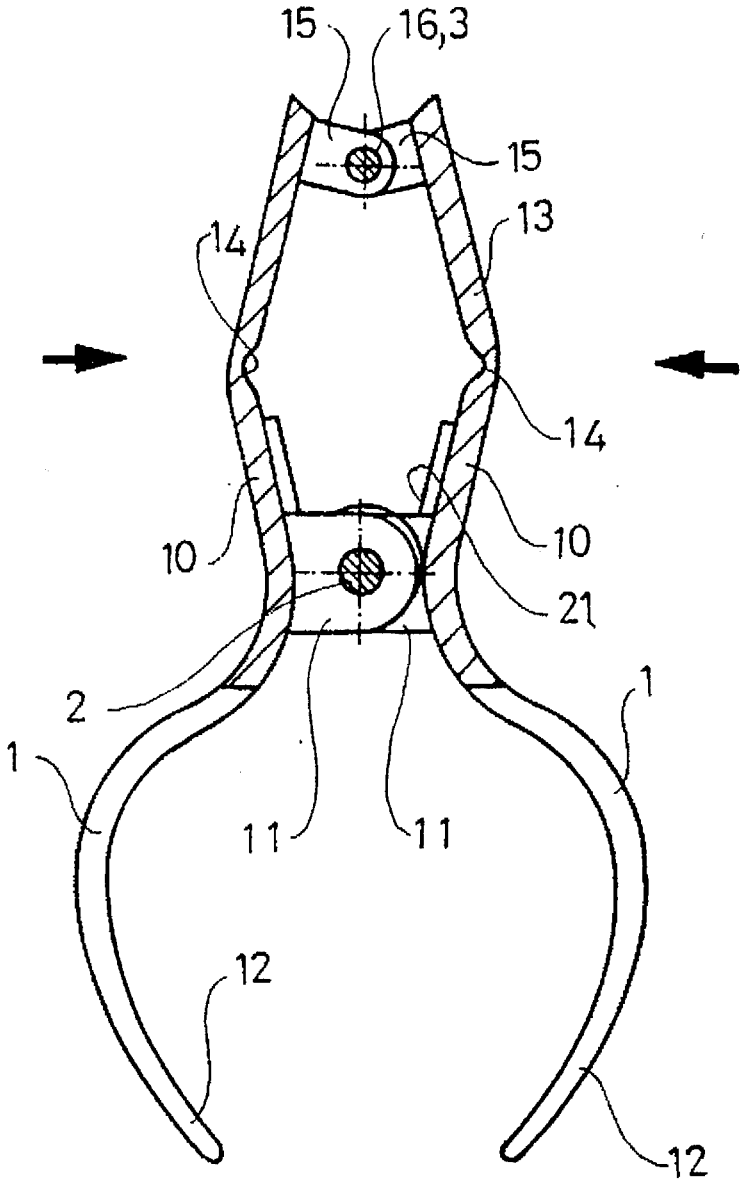

In operation, as shown in FIG. 4, when the handles 10 are forced toward each other against the spring 21, the panels 13 may rotate relative to each other about the pivot pin 3 such that the panels 13 will not affect the operation of the hair holder.

Figure 5:
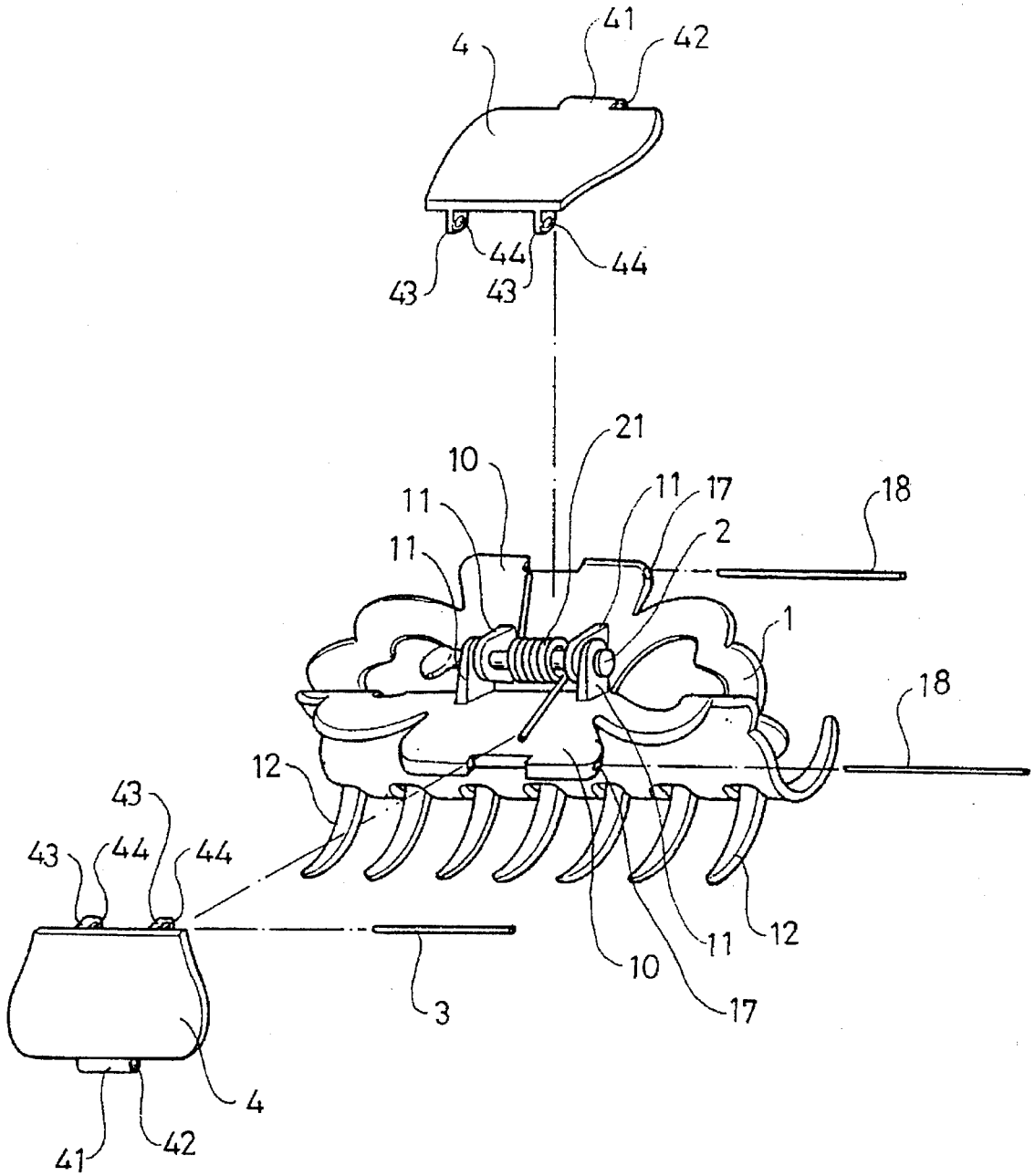
FIG. 5 is a partial exploded view illustrating another embodiment of the hair holder.
Figure 6:
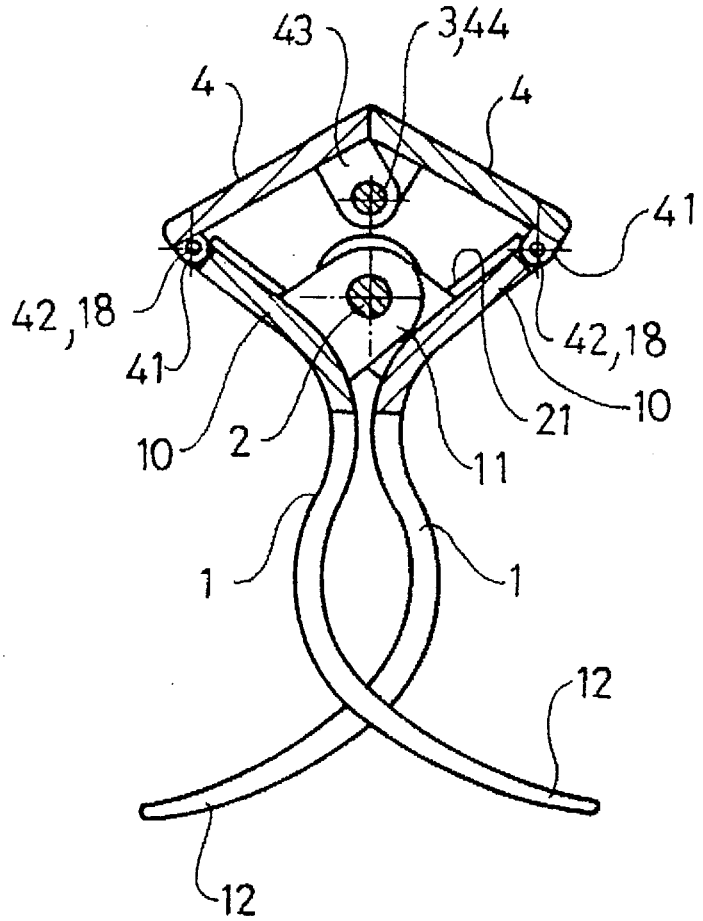
FIG. 6 is a cross sectional view similar to FIGS. 3 and 4, illustrating the configuration of the hair holder as shown in FIG. 5.

Referring next to FIGS. 5 and 6, the panels 4 each also includes a pair of ears 43 extended from one edge thereof and each having a hole 44 formed therein for engaging with a pivot pin 3. However, alternatively, the panels 4 each includes an extension 41 extended from the other edge thereof and having an orifice 42 formed therein for engaging with a pivot axle 18 which is engaged through the apertures 17 of the handles 10 so as to pivotally couple the panels 4 to the handles 10 such that the panels 4 may also be rotated relative to the handles 10. The panels 4 may also shield the spring 21.

Figure 7:
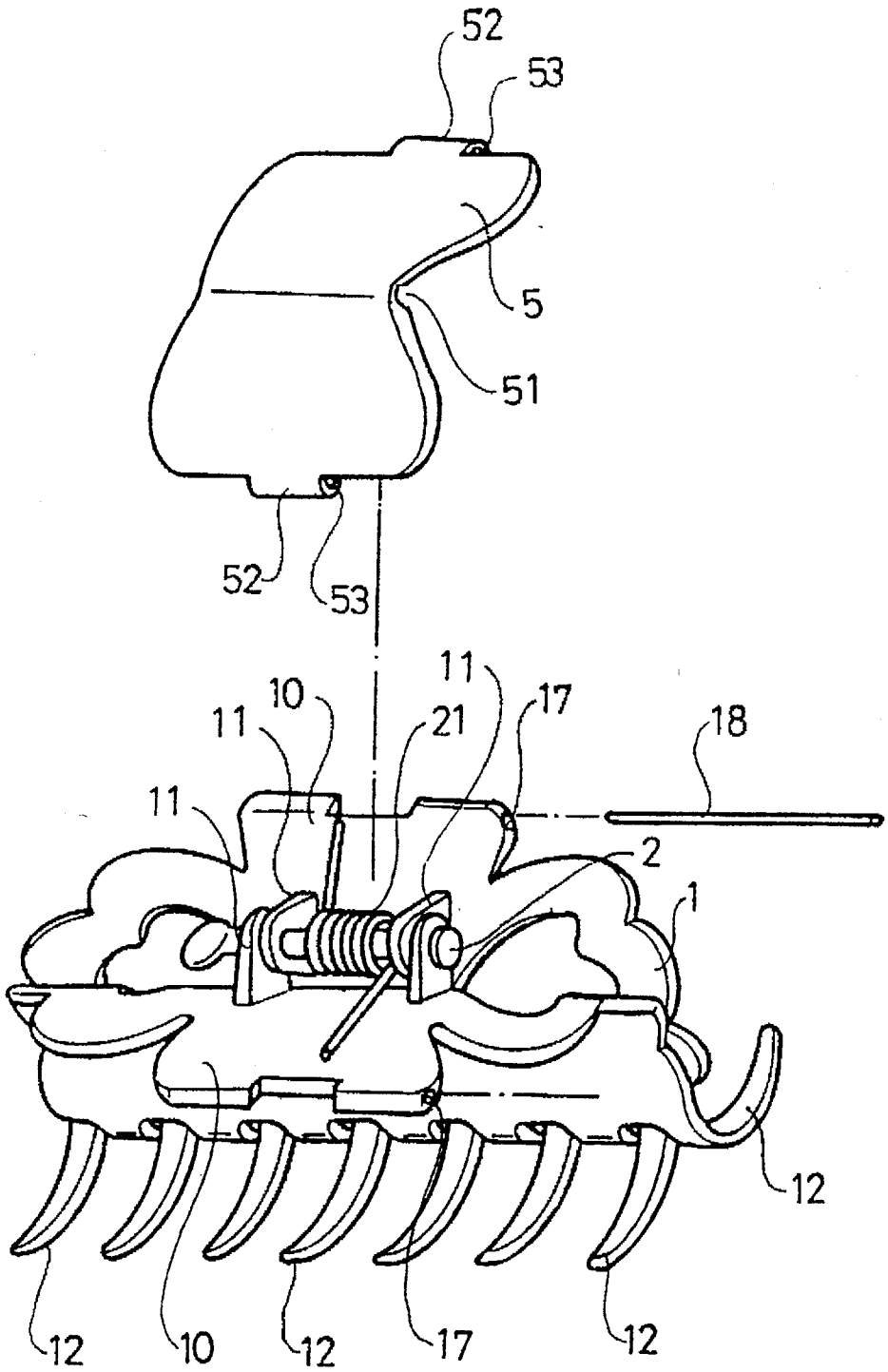
FIG. 7 is a partial exploded view illustrating a further embodiment of the hair holder.
Figure 8:
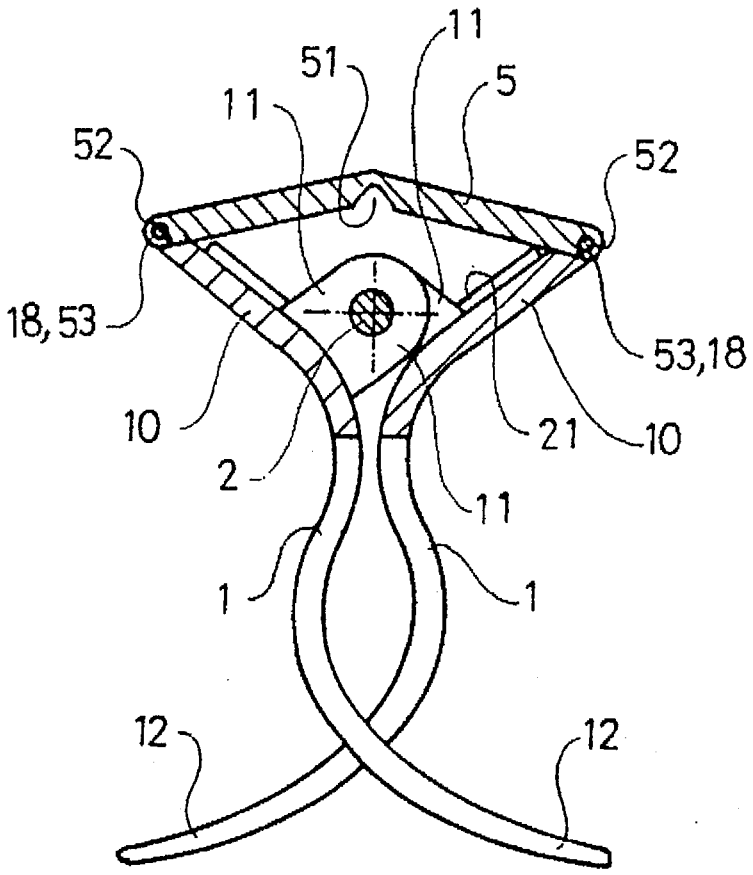
FIG. 8 is a cross sectional view similar to FIGS. 3 and 4, illustrating the configuration of the hair holder as shown in FIG. 7.
Figure 9:
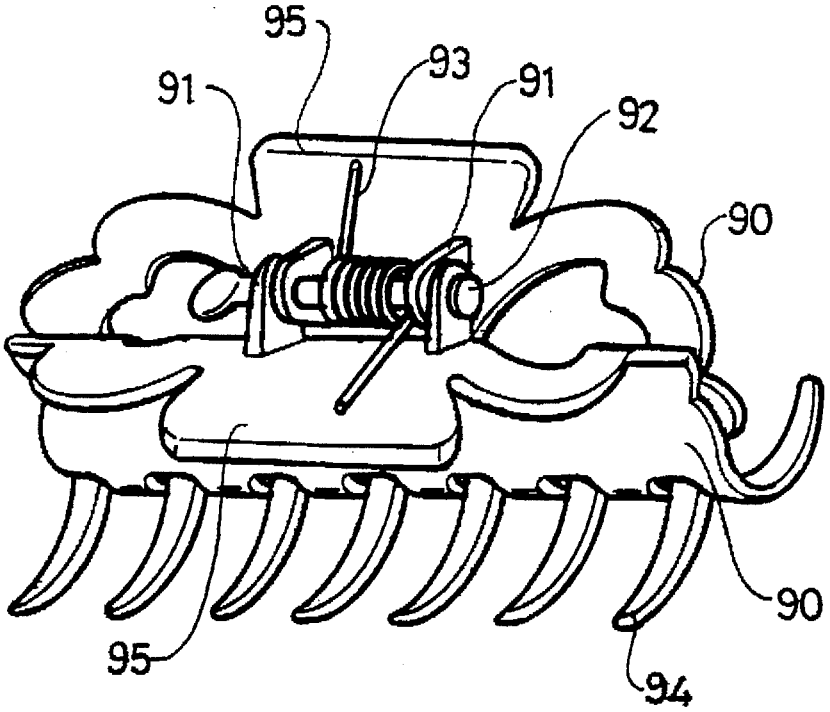
FIG.9 (PRIOR ART)
FIG. 9 is a perspective view showing a typical hair holder.

Referring next to FIGS. 7 and 8, the panels 5 also each includes an extension 52 extended from one edge thereof and having an orifice 53 formed therein for engaging with the pivot axle 18 which is engaged through the apertures 17 of the handles 10 so as to pivotally couple the panels 5 to the handles 10 such that the panels 5 may be rotated relative to the handles 10. However, alternatively, the other edges of the panels 5 are coupled together at a flexible hinge 51. The panels 5 may also shield the spring 21.

Accordingly, the hair holder in accordance with the present invention includes a pair of panels pivotally coupled to the handles and pivotally coupled together so as to shield the spring.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair holder comprising:

a pair of bodies including a middle portion pivotally coupled together at a pivot shaft, said bodies each including a lower portion having a plurality of teeth extended therefrom and each including an upper portion having a handle formed therein, means for biasing said handles away from each other and for biasing said teeth toward each other, and a pair of panels each including a first edge pivotally coupled to said handles and each including a second edge pivotally coupled together so as to allow said panels to rotate relative to each other and to rotate relative to said handles and so as to allow said panels to shield said pivot shaft and said biasing means.

2. A hair holder according to claim 1, wherein said first edges of said panels are pivotally coupled to said handles at a flexible hinge so as to allow said panels to rotate relative to said handles.

3. A hair holder according to claim 1, wherein said first edges of said panels each includes an extension extended therefrom and each includes a pivot axle engaged through said extension and engaged through said handles so as to pivotally couple said panels to said handles and so as to allow said panels to rotate relative to said handles.

4. A hair holder according to claim 1, wherein said second edges of said panels are pivotally coupled together at a flexible hinge so as to allow said panels to rotate relative to each other.

5. A hair holder according to claim 1, wherein said second edges of said panels each includes a pair of ears extended therefrom, and said hair holder includes a pivot pin engaged through said ears so as to pivotally couple said panels together and so as to allow said panels to rotate relative to each other.

6. A hair holder according to claim 1, wherein said panels include a width greater than that of said pivot shaft so as to shield said pivot shaft and said spring.

* * * * *